United States Patent [19]

Ortlieb et al.

[11] Patent Number: 4,852,735

[45] Date of Patent: Aug. 1, 1989

[54] BREAKAWAY CRATE BASE

[75] Inventors: Orlen J. Ortlieb, Galesburg, Ill.; Donald R. Bartlett, West Plains, Mo.

[73] Assignee: Maytag Corporation, Newton, Iowa

[21] Appl. No.: 241,260

[22] Filed: Sep. 7, 1988

[51] Int. Cl.[4] ..... B65D 81/02

[52] U.S. Cl. ..... 206/320; 108/51.3; 206/594; 229/23 A

[58] Field of Search ..... 108/51.3; 206/320, 386, 206/592, 594; 220/1.5; 229/23 A, 23 R

[56] References Cited

U.S. PATENT DOCUMENTS

| | | | |
|---|---|---|---|
| 2,753,101 | 7/1956 | Zimmerman | 206/320 |
| 2,779,463 | 1/1957 | Zimmerman | 206/320 |
| 2,932,438 | 4/1960 | Smith . | |
| 3,080,690 | 3/1963 | Budd | 108/51.3 |
| 3,504,842 | 4/1970 | Grafslund | 206/320 |
| 3,575,288 | 4/1971 | Brucken . | |
| 3,648,959 | 3/1972 | Wagner | 206/320 |
| 3,907,241 | 9/1975 | Oglesby et al. | 206/320 |
| 3,934,805 | 1/1976 | Elaschuk | 206/320 |
| 4,130,199 | 12/1978 | Sorenson | 206/320 |
| 4,204,598 | 5/1980 | Adams . | |
| 4,375,261 | 3/1983 | Kitchell . | |
| 4,402,406 | 9/1983 | Weathers et al. . | |

*Primary Examiner*—Jimmy G. Foster

*Attorney, Agent, or Firm*—Bacon & Thomas

[57] ABSTRACT

A base for supporting an appliance in a crate wherein the base is attached to the bottom of the appliance by the existing leveling screws and is formed from a tearable material which permits the base to be torn and removed from the appliance without the need for removing the leveling screws.

9 Claims, 2 Drawing Sheets

BREAKAWAY CRATE BASE

BACKGROUND OF THE INVENTION

1. Field of the Invention

The present invention generally involves the field of technology pertaining to shipping and storage containers for large appliances. More specifically, the invention relates to an improved removable base for supporting an appliance in a shipping crate.

2. Description of the Prior Art

The shipping of heavy and large appliances in crates generally requires properly supporting the appliance within the crate to prevent its shifting and possible damage. This is accomplished by securing a base to the bottom of the appliance, with the base being sized to the interior dimensions of the crate. Conventional crate bases are typically of wood construction and formed from the lowest grade of lumber available. Such lumber is usually rough-cut, unfinished and has a high water content which gives off an objectionable odor and imparts dimensional instability to the base. A wood crate base must be bolted or otherwise secured to the bottom of the appliance by means of appropriate mechanical fasteners, and requires the subsequent removal of the fasteners after the appliance has been removed from the crate in order to detach the base from the appliance.

SUMMARY OF THE INVENTION

It is an object of the invention to provide an improved crate base for an appliance, wherein the base may be quickly and easily attached to and removed from the appliance.

It is another object of the invention to provide an improved crate base which is of simple construction and may be economically manufactured.

It is a further object of the invention to provide an improved crate base which is light in weight, dimensionally stable and has sufficient strength for properly supporting a heavy appliance in a shipping crate.

These and other objects of the invention are realized by providing an improved crate base in the form of a rectangular-shaped panel made from corrugated board and provided with a plurality of die cut flaps which fold outwardly from the panel for disposition in superimposed overlying engagement with the panel. Each flap is provided with a hole positioned in axial alignment with an aperture formed in the panel for receiving an appliance leveling screw therethrough to attach the panel to the bottom of the appliance. Each flap is provided with a score line which extends from the hole to the outer perimeter of the flap, and each aperture is provided with a score line which extends therefrom to the outer perimeter of the panel, with the score lines being aligned at each corner of the panel, thereby permitting the panel to be grasped and torn at the score lines and removed from the appliance without the need for removing the leveling screws.

Other objects, features and advantages of the invention shall become apparent from the following detailed description of a preferred embodiment thereof, when taken in conjunction with the drawings wherein like reference characters refer to corresponding parts of the several views.

DETAILED DESCRIPTION OF THE PREFERRED EMBODIMENT

Figure 1:
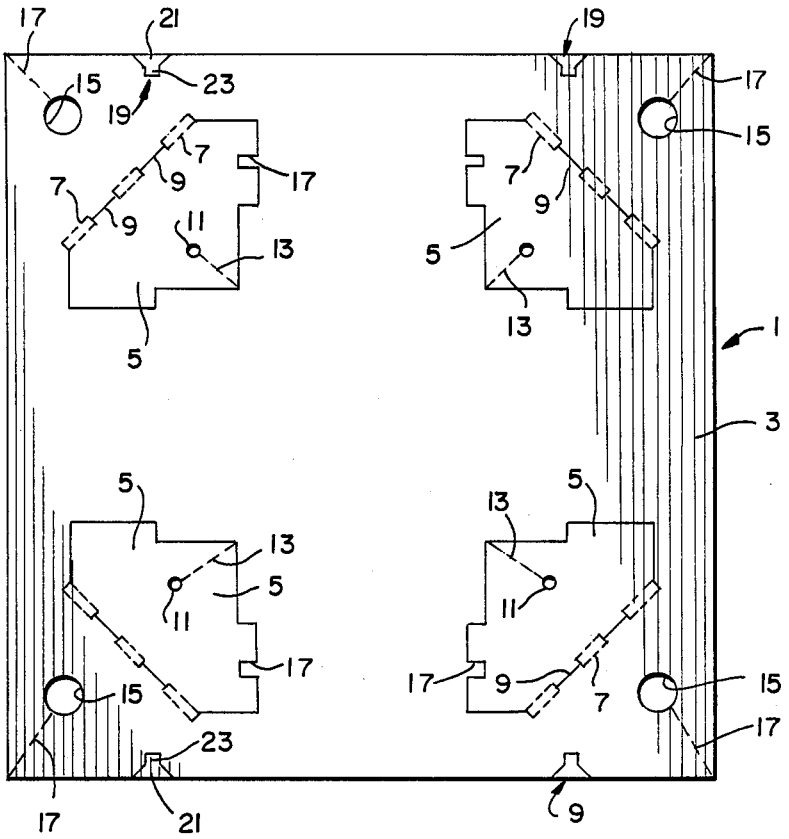
FIG. 1 is a top plan view of a crate base according to a preferred embodiment of the invention, and particularly depicting the manner in which a panel forming the base is die cut to define the flaps and score lines.
Figure 2:
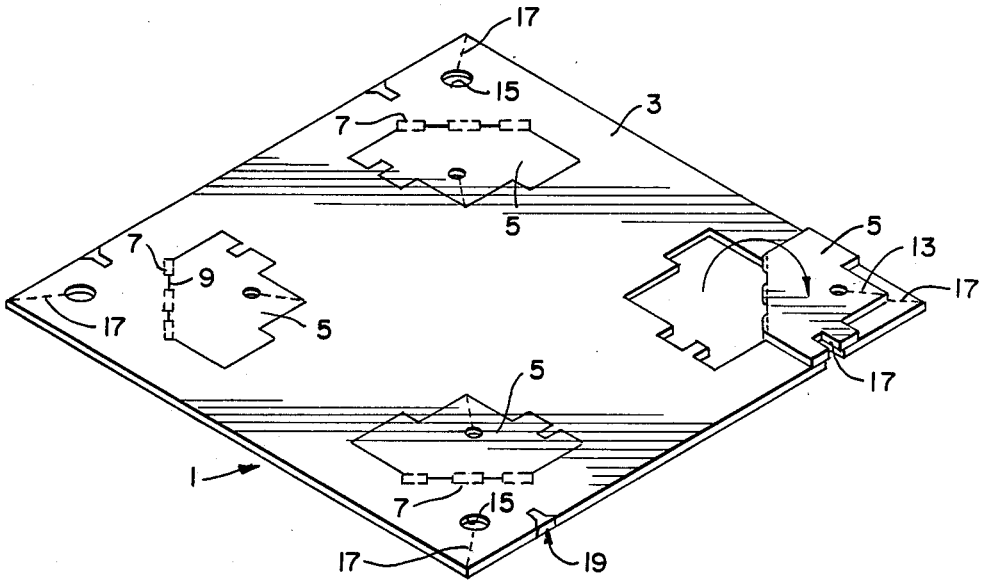
FIG. 2 is a perspective view of the crate base shown in FIG. 1, and depicted with one flap of the panel being folded outwardly and disposed in a superimposed overlaying engagement position with the panel.

A crate base 1, according to a preferred embodiment of the invention shall be described with initial reference to FIGS. 1 and 2. As shown therein, base 1 is defined by a panel 3 having a preferably rectangular configuration, and corresponding in size and shape to the bottom of an appliance to which base 1 is intended to be secured prior to the crating of the appliance. Panel 3 is formed from a material capable of being easily torn or broken away, such as double wall corrugated paperboard. Other types of materials well known in the art may also be advantageously utilized, provided such materials have the capability of being fairly easily tearable and also possess sufficient structural strength and dimensional stability required for the intended purpose and function of base 1.

Panel 3 is provided with a plurality of flaps 5 which are formed therein by die cutting the configuration of each flap through panel 3 by any conventional die cutting method or apparatus. Each flap 5 remains hinged to panel 3 by three pairs of parallel perforated score lines 7 and two H-shaped die cut lines 9 therebetween. The spacing between each pair of score lines 7 is substantially equal to the thickness of panel 3 in order to permit each flap 5 to be folded outwardly of panel 3 and be disposed in a superimposed overlying engagement position with respect thereto. This is clearly shown for a single flap 5 in FIG. 2. The pivotal axis of each hinge line defined by score lines 7 and die cut lines 9 is preferably disposed perpendicular to an imaginary line bisecting the corresponding corner angle of panel 3. Thus, in the preferred embodiment of FIG. 1 as depicted, there are four flaps 5 disposed at the respective four corners of panel 3.

As also apparent in FIGS. 1 and 2, each flap 5 is also provided with a die cut hole 11 therethrough and a first perforated score line 13 which extends from the perimeter of hole 11 to the outer perimeter of flap 5. The corresponding corner of each flap 5 is also provided with an adjacent aperture 15 and a second perforated score line 17 which extends from the perimeter of aperture 15 to the outer corner perimeter of panel 3. Hole 11 and aperture 15 are each of a circular configuration, with the diameter of aperture 15 being preferably greater than that of hole 11. When each flap 5 is folded over onto panel 3 in the manner shown in FIG. 2, hole 11 and aperture 15 are disposed in coaxial alignment for receiving the existing leveling screw of an appliance therethrough. In this configuration, it is also apparent that first and second score lines 13 and 17 overlie each other in direct alignment, and also in alignment with the imaginary line bisecting the corresponding corner angle.

Figure 3:
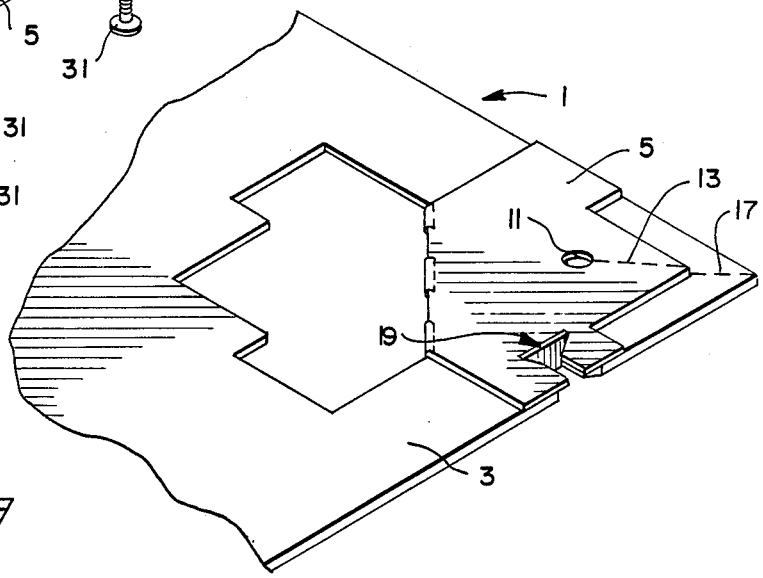
FIG. 3 is a partial perspective view of one corner of the crate base showing a flap in its superimposed overlying engagement position and securing means engaged with the flap for maintaining same in such position.

Each flap 5 is also provided with a die cut slot 17 formed therein for the purpose of securing flap 5 in the superimposed position shown in FIG. 2. This is accomplished by also die cutting a locking tab 19 inwardly of each corner and aligned directly below slot 17 when flap 5 is folded onto panel 3. Tab 19 is defined by an enlarged portion 21 and an associated base portion 23, the latter remaining hinged to panel 3 to permit tab 19 to be folded outwardly therefrom. The width of base portion 23 is substantially the same as that of slot 17 so that tab 19 may be secured onto slot 17 in the manner shown in FIG. 3.

Figure 4:
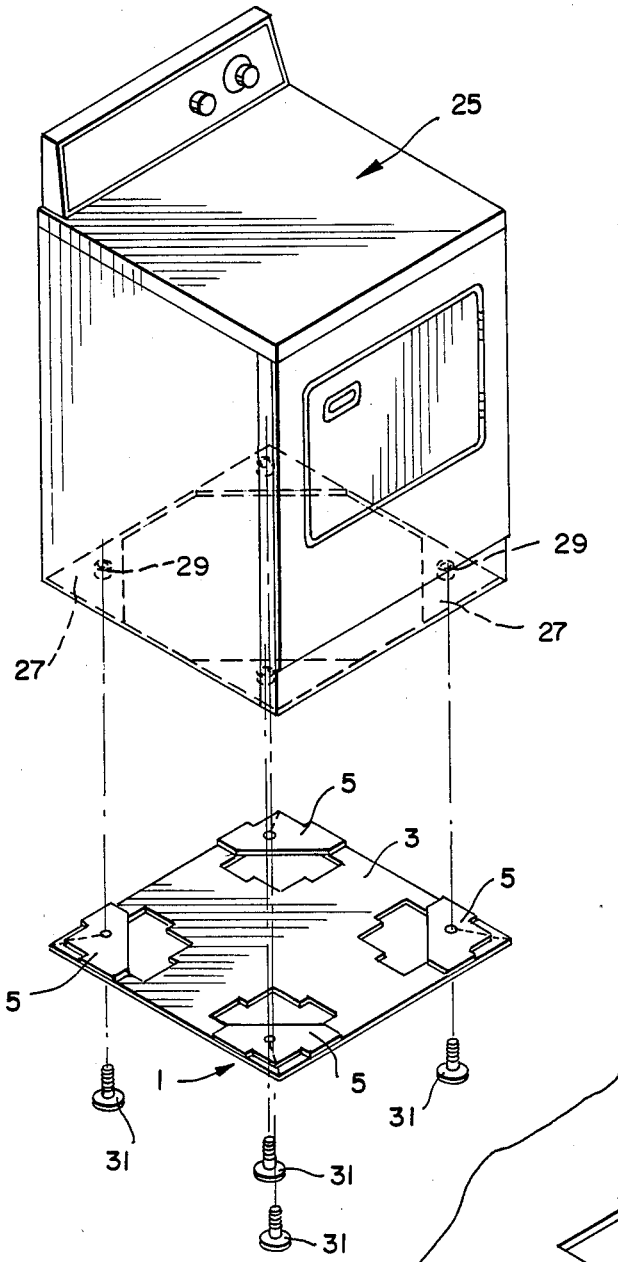
FIG. 4 is an exploded perspective view of the crate base shown in FIG. 1, and depicted with all flaps folded outwardly and disposed in their superimposed overlying engagement positions for attachment to the bottom of an appliance by the existing leveling screws of the appliance.

The manner in which crate base 1 is used for supporting an appliance shall now be described with reference to FIG. 4. In this case, an appliance 25 is shown to be a conventional clothes dryer, although it is understood that any other type of similar appliance may be utilized in conjunction with the invention.

Appliance 25 includes a bottom portion 27 provided with a plurality of spaced threaded apertures 29 for receiving a corresponding number of threaded leveling screws 31 that function as the supporting feet for appliance 25. The threaded engagement between screws 31 and apertures 29 permit the leveling of appliance 25 in a manner well known in the art. The attachment of crate base 1 to bottom portion 27 of appliance 25 is accomplished by first folding flaps 5 outwardly to dispose same in their respective superimposed overlying engagement positions on panel 3 and securing flaps 5 in such positions by means of locking tabs 19, in the manner shown in FIG. 3. Thereafter, each leveling screw 31 is inserted through its corresponding aperture 15 and hole 11 and threadedly engaged within the threaded aperture 29. This serves to secure base 1 to appliance 25 so that the latter may be packed and shipped in an appropriate crate or shipping container. When appliance 25 is uncrated for installation, removal of base 1 is easily accomplished by simply grasping and tearing along first and second score lines 13 and 17 at each corner thereof, thereby freeing base 1 from leveling screws 31 and permitting base 1 to be broken away from bottom portion 27 while leveling screws 31 remain threadedly engaged therewith.

In the preferred embodiment of crate base 1 as described herein, it is preferable that first and second score lines 13 and 17 for each flap 5 extend diagonally to the corresponding corner of panel 3 and that first score line 13 terminates at a corner formed in flap 5. This serves to dispose the weakened portions of base 1 at the corners thereof, thereby maintaining optimum front-to-rear and side-to-side structural strength required for supporting appliance 5 during the handling and shipping thereof.

While an appliance 25 is shown with existing leveling screws 31 associated therewith, it is clear that any appliance with similar mechanical devices or fasteners may be utilized to advantage in the attachment of base 1 thereto for the practice of the invention. The preferred use of doublewall corrugated board is further advantageous in that it provides a smooth surface which will not mark or mar linoleum or other fine finished floors during the uncrating and installation of appliance 25.

It is to be understood that the form of the invention herein shown and described is to be taken as a preferred embodiment thereof, and that various changes in shape, material, size and arrangement of parts may be resorted to without departing from the spirit of the invention or scope of the subjoined claims.

We claim:

1. A breakaway crate base for attachment to an appliance provided with a plurality of leveling screws at the bottom of the appliance, the base comprising:

(a) a panel formed from tearable material;

(b) a plurality of flaps formed in the panel, each flap being die cut from and hinged to the panel for folding outwardly of the panel along a hinge axis for disposition in a superimposed overlying engagement position therewith;

(c) each flap including a hole positioned to receive a leveling screw therethrough for attaching the panel to the bottom of an appliance; and (d) tearing means formed in the panel to permit the panel to be torn and removed from the appliance without requiring removal of the leveling screws.

2. The crate base of claim 1 wherein the tearing means includes a plurality of score lines formed in the panel.

3. The crate base of claim 1 wherein the tearing means includes:

(a) a first score line extending from the perimeter of each hole to the outer perimeter of its corresponding flap;

(b) a plurality of apertures formed in the panel, each aperture corresponding to a flap;

(c) a second score line extending from the perimeter of each aperture to the outer perimeter of the panel; and (d) the hole in each flap and its corresponding aperture are axially aligned when the flap is disposed in the superimposed overlying engagement position to permit insertion of a leveling screw therethrough.

4. The crate base of claim 3 wherein each hole and each aperture are of a circular configuration, with the diameter of the apertures being larger than the diameter of the holes.

5. The crate base of claim 3 wherein the panel is of a substantially rectangular configuration and including four flaps positioned adjacent the corners of the panel, with each second score line extending to its corresponding corner.

6. The crate base of claim 5 wherein the hinge axis of each flap is perpendicular to a line bisecting its corresponding corner angle, with the first and second score lines being disposed in alignment with the line when the flap is disposed in its superimposed overlying engagement position.

7. The crate base of claim 1 wherein the panel is formed from corrugated board.

8. The crate base of claim 1 further including means for securing each flap in the superimposed overlying engagement position.

9. The crate base of claim 8 wherein the securing means including a tab defined by an enlarged portion and a base portion, the tab being die cut from and hinged at its base portion to the panel for folding outwardly of the panel, a slot formed in the flap and having a width substantially equal to the width of the base portion, with the base portion being engageable within the slot and retained therein by the enlarged portion.

* * * * *